US007549932B1

(12) United States Patent
Miyamoto

(10) Patent No.: US 7,549,932 B1
(45) Date of Patent: Jun. 23, 2009

(54) GOLF CLUB PRACTICE SWING ACCOMMODATING APPARATUS

(76) Inventor: Yukio M. Miyamoto, 231 Winston Ave., West Covina, CA (US) 91791

( * ) Notice: Subject to any disclaimer, the term of this patent is extended or adjusted under 35 U.S.C. 154(b) by 422 days.

(21) Appl. No.: 11/450,239

(22) Filed: Jun. 12, 2006

(51) Int. Cl.
*A63B 69/36* (2006.01)

(52) U.S. Cl. ..... 473/278

(58) Field of Classification Search ..... 473/278, 473/218, 257, 262, 279
See application file for complete search history.

(56) References Cited

U.S. PATENT DOCUMENTS 3,423,096 A * 1/1969 Tone ..... 473/278
4,955,611 A * 9/1990 Moller ..... 473/262
5,156,398 A * 10/1992 Kibamoto ..... 473/278
5,273,285 A * 12/1993 Long ..... 473/278
5,593,355 A * 1/1997 Beaver ..... 473/278
5,692,967 A * 12/1997 Guyer ..... 473/262
6,106,409 A * 8/2000 Jackson, Jr. ..... 473/278
6,156,396 A * 12/2000 Florian ..... 428/17
6,902,494 B1 * 6/2005 Frishberg ..... 473/278
6,994,634 B1 * 2/2006 McFarlin et al. ..... 473/278
2006/0135280 A1 * 6/2006 Kim ..... 473/278
2008/0032811 A1 * 2/2008 Bearden ..... 473/278

FOREIGN PATENT DOCUMENTS

GB 2315024 A * 1/1998

* cited by examiner

*Primary Examiner*—Raleigh W. Chiu
(74) *Attorney, Agent, or Firm*—William W. Haefliger

(57) ABSTRACT

Golf equipment, comprising in combination a ground sheet, a golf ball support associated with the sheet facing upwardly relative to a deflectable portion of the sheet, and means providing sheet support to allow downward deflection of the portion during swinging of a golf club head acting to strike the ball and to sweepingly engage and downwardly bodily deflect the portion of the sheet.

14 Claims, 3 Drawing Sheets

GOLF CLUB PRACTICE SWING ACCOMMODATING APPARATUS

BACKGROUND OF THE INVENTION

This invention relates generally to enhancing practice driving of golf balls, as at driving ranges; and more particularly to apparatus and method to enable enhanced simulation of actual use of golf irons (as on fairways) at driving ranges.

It is well known that desired stroking of a golf ball, on a fairway, involves production of a divot, i.e. cutting of a section of turf attached to dirt. This involves swinging of the iron so that it downwardly cuts into the turf, at the golf ball location.

At a practice tee on a driving range, this cutting action cannot be repeated, since the ground or surface or artificial turn at the tee location is normally hardened or immovable bodily downwardly, and the golfer's swing must be undesirably adjusted so that the head lower edge swings closely adjacent i.e. skims the ground surface or to the artificial turf. There is need for substantial improvements to overcome such problems.

SUMMARY OF THE INVENTION

It is a major object to provide improved apparatus and method to meet that need.

Basically, this is provided by the following elements, or features, in combination:

a) a ground simulating sheet, b) a golf ball support associated with the sheet and facing upwardly relative to a deflectable portion of the sheet, c) and means providing sheet support to allow downward deflection of said portion during swinging of a golf club head acting to strike the ball and to sweepingly engage and downwardly bodily deflect said portion of the sheet.

The ground sheet may be solid, or may include artificial turf, and as will be seen, a structural cavity may typically be provided below said portion of the sheet to accommodate downward deflection of that sheet portion.

It is another object to provide the support means to include a resiliently downwardly yieldable mat portion extending beneath the sheet portion to yieldably resist downwardly bodily movement thereof.

A hole may be provided in that surface sheet portion, and through which the golf ball support extends upwardly. The golf ball support, such as an elastomeric stem may be carried by the ground sheet, or mat.

Yet another object is to provide frame structure carrying the sheet and mat, and easily installable at a driving range. An auxiliary stand for the user's feet as he addresses the ball and deflectable apparatus, may also be provided.

The method of use of the apparatus as referred to may include the steps:

$x_1$) swinging the club to cause the club head to sweepingly engage said sheet portion proximate said support, and so as to downwardly and bodily deflect that sheet portion, $x_2$) and allowing the downwardly bodily deflected sheet portion to recover, i.e. move bodily upwardly toward an initial position.

These and other objects and advantages of the invention, as well as the details of an illustrative embodiment, will be more fully understood from the following specification and drawings, in which:

DRAWING DESCRIPTION

Figure 1A:
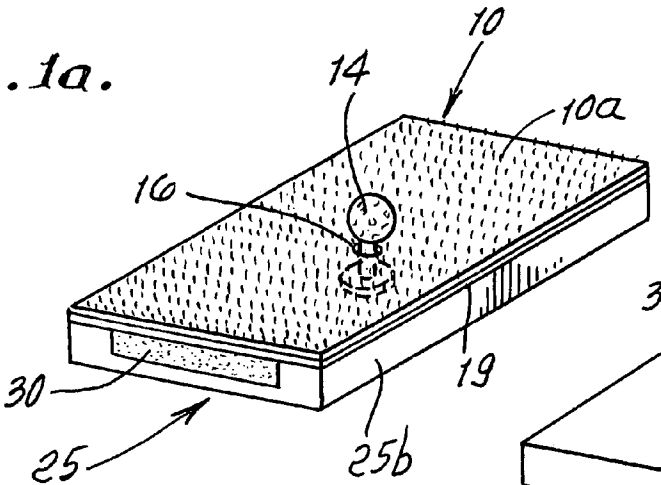
Figures 1B, 1C, 1D, 1E:
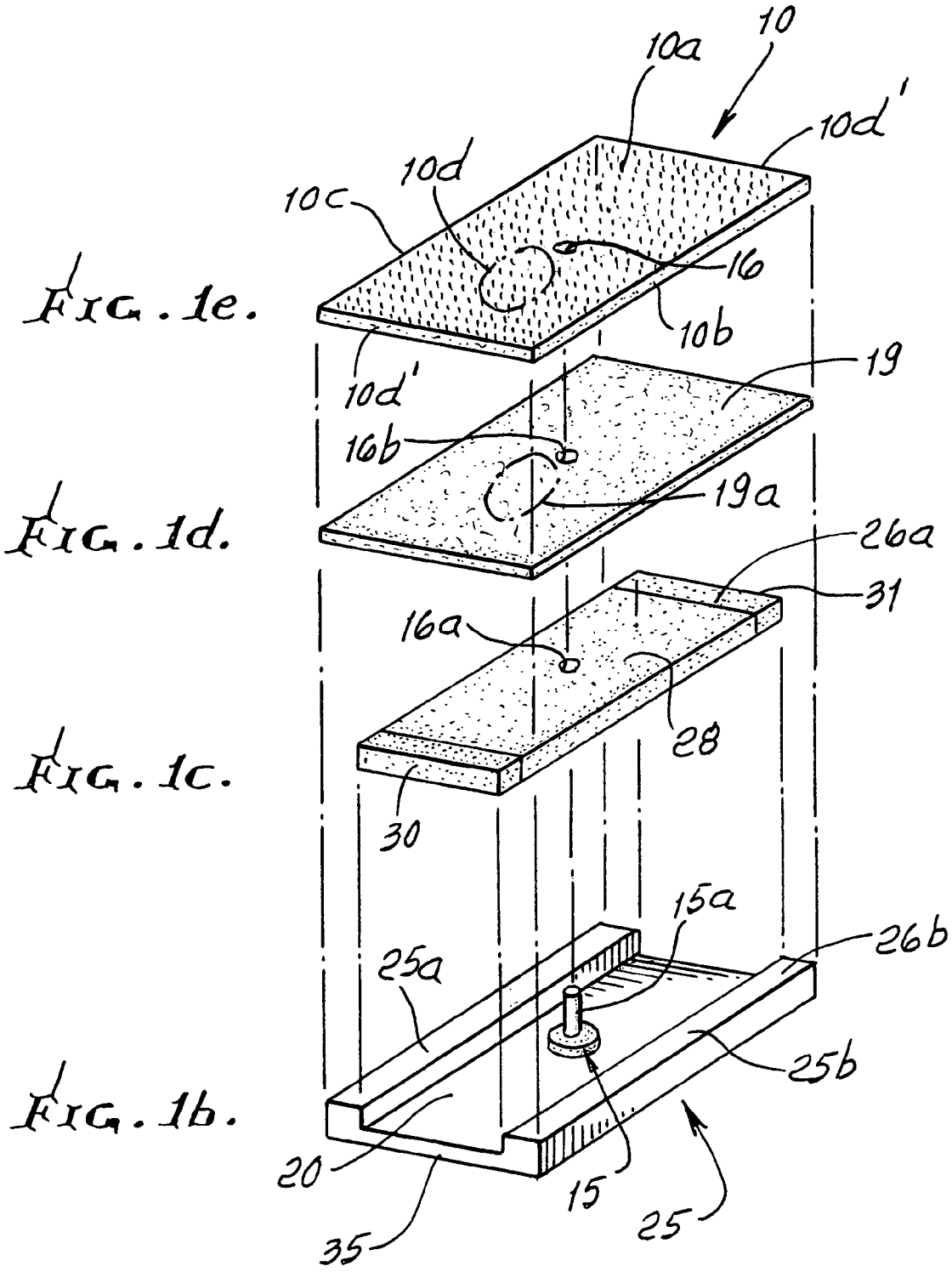

FIG. 1*a* is a perspective view of apparatus incorporating the invention;

FIG. 1*b* is a perspective view of a support frame, defining a cavity;

FIG. 1*c* is a perspective view of end wall structure;

FIG. 1*d* is a perspective view of an elastomer mat;

FIG. 1*e* is a perspective view of a surface sheet, as for example with artificial turf, to overlie the elements of FIGS. 1*b* through 1*d;*

Figure 4:
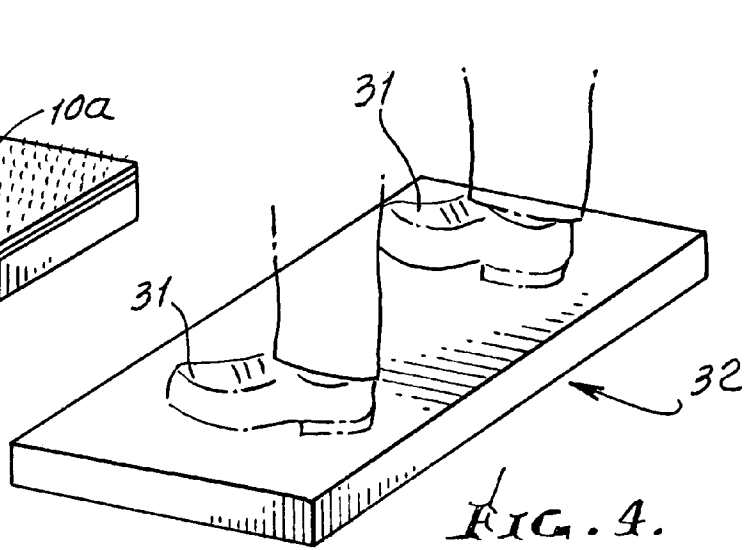
Figure 2:
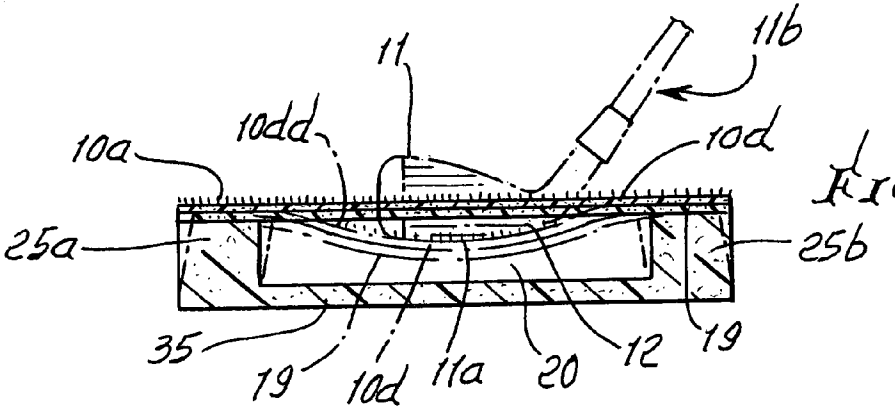
Figure 3A:
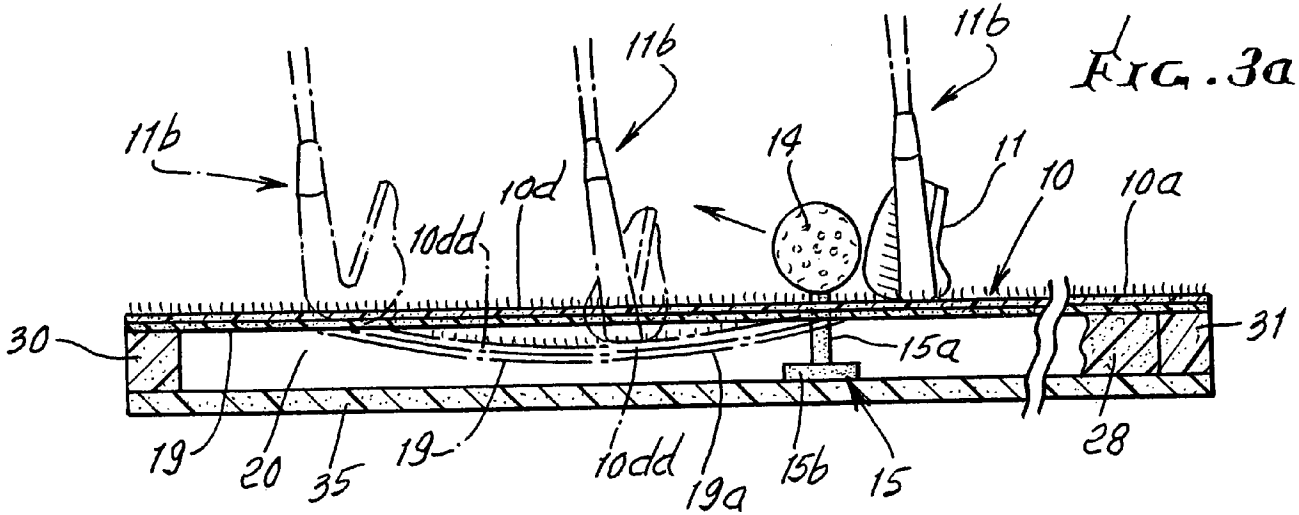
Figure 3B:
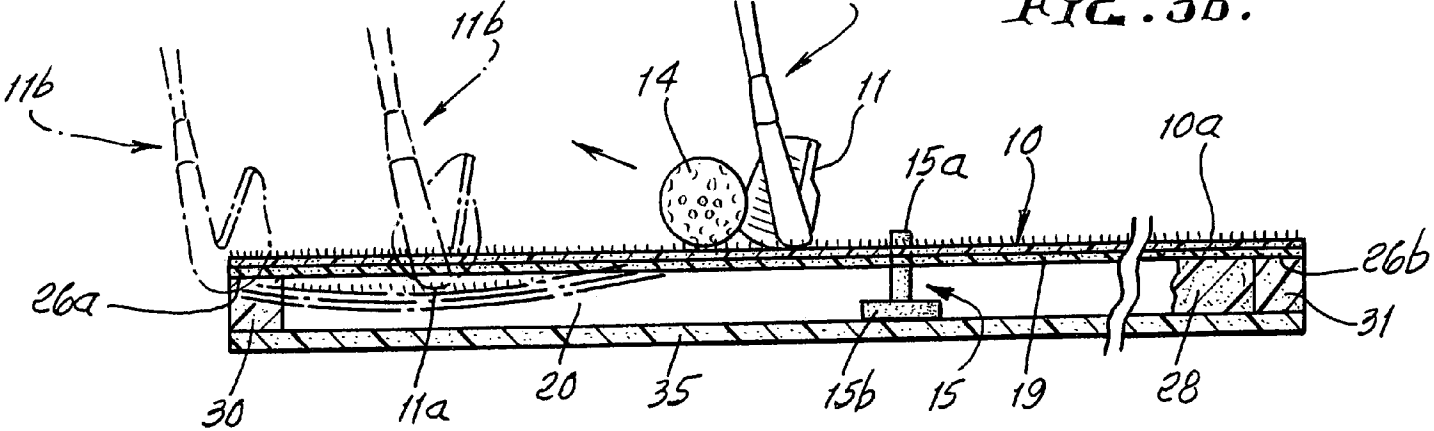

FIG. 2 is a vertical section showing deflection of the mat and top sheet, effected by a club head during a golf club swing;

FIG. 3*a* is a section of the FIG. 2 structure, showing a sequence of club head positions during club swinging;

FIG. 3*b* is a view like FIG. 3*a*, but with the ball initial position shifted relative to the top sheet; and FIG. 4 is a perspective view of a stand to support the user's feet, during club swinging.

DETAILED DESCRIPTION

In the drawings, showing preferred apparatus, a ground simulating sheet 10 has a top surface, which may include artificial (plastic) turf 10*a*. It may be rectangular in outline, having opposite elongated edges 10*b* and 10*c*, and opposite ends 10*d*'. Sheet 10 is flexible, so as to be locally deflectable downwardly when struck by the sweeping lower edge 11*a* of a golf club head 11, as during swinging of a golf club 11*b*. Sheet 10 may consist of plastic or rubbery material.

A mid-portion 10*d* of sheet 10 is adapted for close association with a golf ball, so as to be struck and downwardly deflected, as described, and as shown in FIGS. 2, 3*a* and 3*b*. The region 12 between the position of the undeflected sheet mid-portion 10*d*, and the position of the downwardly deflected sheet mid-portion 10*dd* represents the shape of a phantom divot that would be sliced from the fairway if the iron head were swung from right to left as indicated in FIGS. 3*a* and 3*b*. The golf ball being struck is shown at 14.

A golf ball support 15 is provided, in association with the sheet 10, and faces upwardly at its upper terminus 15*a* relative to the deflectable upper sheet portion 10. A through hole 16 may be provided in 10 to pass the stem 15*b* of the support 15, so that the ball is centered and supported at terminus 15*a*. Otherwise, the ball may be supported on 10*a*, or at the upper annular edge of the hole 16.

A means is preferably used to provide support for sheet 10, in such a way as to allow downward deflection of mid-portion 10*d*, as shown, yieldably resisting such deflection, during swinging of the club head to strike the golf ball, as the head sweepingly engages and downwardly bodily reflects the sheet portion 10*d*. Note the downwardly deflected position of the sheet mid-portion 10*dd* in a cavity 20 formed below the sheet 10, in FIG. 2, 3*a* and 3*b*.

Such means may, with unusual advantage, comprise a resiliently yieldable, downwardly deflectable mid-portion 19*a* of a mat 19, located directly beneath the sheet 10. Mat 19 may consist of an elastomer, such as natural or synthetic rubber, to yieldably resist downward deflection of its mid-portion 19*a*, directly below sheet 10 mid-portion 10*a*, so that both move bodily downwardly together into the cavity 20, while resisting such deflection in a manner similar to resistance of fairway earth and turf cut out in a divot, during club head swinging. A frame base 35 may support the base 15*b* of the support 15, at the lower end of elastomeric stem 15*a*, and base 15*b* may be bonded to the base 35. Accordingly, the apparatus allows club head swinging to locally downwardly deflect the sheet mid portion 10*a* and the mat mid-portion 19*a*, the surrounding zones of the sheet and mat being placed in tension to add to the resistance to downward deflection of portions boa and 19*a*, in order to better simulate the resistance to divot formation on a fairway.

FIGS. 1*a* and 1*b* show a frame structure 25 to carry the mat 19 and sheet 10, as by bonding attachment at 26*a* and 26*b*. See FIG. 2, 3*a* and 3*b*. The attachment is preferably to edge portions of 10 and 19, whereby the zone between frame elongated members 25*a* and 25*b* forms the open cavity to downwardly receive the mid-portions 10*a* and 19*a*. Compressible structure indicated at 28 may be used and received in the cavity to provide yieldable resistance to downward local deflection of 10 and 19. End frame members are seen at 30 and 31.

A stand to support the golfer's feet 31 is shown at 32 in FIG. 4, and is spaced laterally from 25. Both 25 and 32 are shown as rectangular, for ease of accurate placement at a driving range, for use.

In use, the following method steps are followed:

a) providing a ground sheet, b) providing a golf support associated with said sheet and facing upwardly relative to a deflectable portion of the sheet, c) employing means providing sheet support to allow downward deflection of said sheet portion during swinging of a golf club head acting to strike the ball and to sweepingly engage and downwardly bodily deflect said portion of the sheet, d) and swinging said club to cause said head to sweepingly engage said sheet portion proximate said support, and so as to yieldably downwardly and bodily deflect said sheet portion, e) and allowing said downwardly bodily deflected sheet portion to move bodily upwardly toward initial position.

The referenced means is provided to include a resiliently downwardly yieldable elastomeric mat portion extending beneath said sheet portion to move resiliently and yieldably downwardly and upwardly therewith.

I claim:

1. Golf equipment, comprising in combination:

a) a ground sheet, b) a golf ball support associated with said sheet facing upwardly relative to a downwardly deflectable portion of the sheet, c) and means providing sheet support to allow downward deflection of said portion during swinging of a golf club head acting to strike the ball and to sweepingly engage and downwardly bodily deflect said portion of the sheet, d) said means including a resiliently downwardly yieldable mat portion extending beneath said sheet portion to yieldably resist said downwardly bodily movement thereof, e) there being frame structure carrying said sheet and said mat portion, and having forwardly elongated frame members forming therebetween a cavity to downwardly receive the mat portion, said cavity opening forwardly from between said members.

2. The combination of claim 1 wherein said cavity receives said portion of the sheet to deflected downwardly relative to said ball support.

3. The combination of claim 1 including a hole in said sheet portion, and through which said golf ball support extends upwardly.

4. The combination of claim 3 wherein said golf ball support is carried by said frame structure.

5. The combination of claim 4 wherein said golf ball support comprises an elastomeric stem.

6. The combination of claim 1 wherein said golf ball support extends through an opening in said mat portion, between said frame members.

7. The combination of claim 6 wherein said golf ball support comprises an elastomeric stem projecting upwardly above the level of said sheet portion.

8. The combination of claim 7 including a hole in said sheet portion, and through which said stem projects.

9. The combination of claim 1 including elastomeric mat structure integrated with said mat portion, and said ground sheet and mat structure are carried by the frame structure in spaced relation to said golf ball support.

10. The combination of claim 1 including artificial turf on said ground sheet.

11. The combination of claim 1 including said golf ball supported on said support.

12. The combination of claim 1 including an auxiliary stand located laterally of said ground sheet, and on which a golfer stands as he swings the golf club.

13. The method of practice driving a golf ball using a golf club having a head, that includes a) providing a ground simulating sheet, b) providing a golf ball support associated with said sheet facing upwardly relative to a deflectable portion of the sheet, c) providing means to allow downward deflection of said sheet portion during swinging of a golf club head acting to strike the ball and to sweepingly engage and downwardly bodily deflect said portion of the sheet, d) and swinging said club to cause said head to sweepingly engage said sheet portion proximate said support, and so as to downwardly and bodily deflect said sheet portion, e) and allowing said downwardly bodily deflected sheet portion to move bodily upwardly toward an initial position, f) said means including a resiliently downwardly yieldable mat portion extending beneath said sheet portion to yieldably resist said downwardly bodily movement thereof, g) there being frame structure carrying said sheet and said mat, and having forwardly elongated frame members forming therebetween a cavity to downwardly receive the mat portion, said cavity opening forwardly from between said members.

14. The method of claim 13 wherein said cavity is provided directly below said mat portion and into which said mat portion is downwardly yieldably deflectable relative to said ball support.

* * * * *